US009109428B2

(12) United States Patent
Frazier

(10) Patent No.: US 9,109,428 B2
(45) Date of Patent: Aug. 18, 2015

(54) CONFIGURABLE BRIDGE PLUGS AND METHODS FOR USING SAME

(76) Inventor: W. Lynn Frazier, Corpus Christi, TX (US)

( * ) Notice: Subject to any disclaimer, the term of this patent is extended or adjusted under 35 U.S.C. 154(b) by 667 days.

(21) Appl. No.: 13/194,820

(22) Filed: Jul. 29, 2011

(65) Prior Publication Data

US 2011/0277989 A1 Nov. 17, 2011

Related U.S. Application Data

(63) Continuation-in-part of application No. 12/799,231, filed on Apr. 21, 2010, now abandoned.

(60) Provisional application No. 61/214,347, filed on Apr. 21, 2009.

(51) Int. Cl.

| | |
|---|---|
| ***E21B 33/129*** | (2006.01) |
| ***E21B 33/134*** | (2006.01) |
| ***E21B 34/06*** | (2006.01) |
| ***E21B 34/14*** | (2006.01) |

(52) U.S. Cl.

CPC ..... *E21B 33/129* (2013.01); *E21B 33/134* (2013.01); *E21B 34/063* (2013.01); *E21B 34/14* (2013.01)

(58) Field of Classification Search

CPC ..... E21B 23/06; E21B 33/129; E21B 33/134
USPC ..... 166/118, 138, 123, 135, 192
See application file for complete search history.

(56) References Cited

U.S. PATENT DOCUMENTS

| | | | |
|---|---|---|---|
| 1,476,727 | A | 12/1923 | Quigg |
| RE17,217 | E | 2/1929 | Burch |
| 2,040,889 | A | 5/1933 | Whinnen |
| 2,223,602 | A | 10/1938 | Cox |
| 2,160,228 | A | 5/1939 | Pustmueller |
| 2,286,126 | A | 7/1940 | Thornhill |
| 2,230,447 | A | 2/1941 | Bassinger |
| 2,331,532 | A | 10/1943 | Bassinger |
| 2,376,605 | A | 5/1945 | Lawrence |
| 2,593,520 | A | 10/1945 | Baker et al. |
| 2,616,502 | A | 3/1948 | Lenz |
| 2,756,827 | A | 6/1948 | Farrar |
| 2,555,627 | A | 6/1951 | Baker |

(Continued)

FOREIGN PATENT DOCUMENTS

| | | |
|---|---|---|
| GB | 914030 | 12/1962 |
| WO | WO02083661 | 10/2002 |

(Continued)

OTHER PUBLICATIONS

"Teledyne Merla Oil Tools-Products-Services," Teledyne Merla, Aug. 1990 (40 pages).

(Continued)

*Primary Examiner* — Robert E Fuller
(74) *Attorney, Agent, or Firm* — Edmonds & Nolte, P.C.

(57) ABSTRACT

An insert for a downhole plug for use in a wellbore is provided, comprising a body having a bore at least partially formed therethrough, wherein one or more threads are disposed on an outer surface of the body for engaging the plug; and at least one interface is disposed on an end of the body for connecting to a tool to screw the insert into at least a portion of the plug.

27 Claims, 5 Drawing Sheets

(56) References Cited

U.S. PATENT DOCUMENTS 2,714,932 A 8/1951 Thompson
2,589,506 A 3/1952 Morrisett
2,737,242 A 8/1952 Baker
2,630,865 A 3/1953 Baker
2,637,402 A 5/1953 Baker et al.
2,640,546 A 6/1953 Baker et al.
2,671,512 A 3/1954 Ragan et al.
2,695,068 A * 11/1954 Baker et al. ..... 277/338
2,833,354 A 2/1955 Sailers
3,054,453 A 3/1955 Bonner
2,713,910 A 7/1955 Baker et al.
2,830,666 A 7/1956 Rhodes
2,815,816 A 12/1957 Baker
3,062,296 A 12/1960 Brown
3,082,824 A 3/1963 Taylor et al.
3,094,166 A 6/1963 McCullough
3,013,612 A 12/1964 Angel
3,160,209 A 12/1964 Bonner
3,163,225 A 12/1964 Perkins
3,270,819 A 9/1966 Thrane et al.
3,273,588 A 9/1966 Dollison
3,282,342 A 11/1966 Mott
3,291,218 A 12/1966 Lebourg
3,298,437 A 1/1967 Conrad
3,298,440 A 1/1967 Current
3,306,362 A 2/1967 Urbanosky
3,308,895 A 3/1967 Oxford et al.
3,356,140 A 12/1967 Young
3,387,660 A * 6/1968 Berryman ..... 166/133
3,393,743 A 7/1968 Stanescu
3,429,375 A 2/1969 Craig
3,517,742 A 6/1970 Williams
3,554,280 A 1/1971 Tucker
3,602,305 A 8/1971 Kisling
3,623,551 A 11/1971 Randermann, Jr.
3,687,202 A 8/1972 Young et al.
3,787,101 A 1/1974 Sugden
3,818,987 A 6/1974 Ellis
3,851,706 A 12/1974 Ellis
3,860,066 A 1/1975 Pearce et al.
3,926,253 A 12/1975 Duke
4,035,024 A 7/1977 Fink
4,049,015 A 9/1977 Brown
4,134,455 A 1/1979 Read
4,151,875 A 5/1979 Sullaway
4,185,689 A 1/1980 Harris
4,189,183 A 2/1980 Borowski
4,250,960 A 2/1981 Chammas
4,281,840 A 8/1981 Harris
4,314,608 A 2/1982 Richardson
4,381,038 A 4/1983 Sugden
4,391,547 A 7/1983 Jackson
4,405,017 A 9/1983 Allen et al.
4,432,418 A 2/1984 Mayland
4,436,151 A 3/1984 Callihan et al.
4,437,516 A 3/1984 Cockrell
4,457,376 A 7/1984 Carmody et al.
4,493,374 A 1/1985 Magee, Jr.
4,532,995 A 8/1985 Kaufman
4,548,442 A 10/1985 Sugden et al.
4,554,981 A 11/1985 Davies
4,566,541 A 1/1986 Moussy et al.
4,585,067 A 4/1986 Blizzard et al.
4,595,052 A 6/1986 Kristiansen
4,602,654 A 7/1986 Stehling et al.
4,688,641 A 8/1987 Knieriemen
4,708,163 A 11/1987 Deaton
4,708,202 A 11/1987 Sukup et al.
D293,798 S 1/1988 Johnson
4,776,410 A 10/1988 Perkin et al.
4,784,226 A 11/1988 Wyatt
4,792,000 A 12/1988 Perkin et al.
4,830,103 A 5/1989 Blackwell et al.
4,848,459 A 7/1989 Blackwell et al.
4,893,678 A 1/1990 Stokley et al.
4,898,245 A 2/1990 Braddick
5,020,590 A 6/1991 McLeod
5,074,063 A 12/1991 Vannette
5,082,061 A 1/1992 Dollison
5,095,980 A 3/1992 Watson
5,113,940 A 5/1992 Glaser
5,117,915 A 6/1992 Mueller et al.
5,154,228 A 10/1992 Gambertoglio et al.
5,183,068 A 2/1993 Prosser
5,188,182 A 2/1993 Echols, III et al.
5,207,274 A 5/1993 Streich et al.
5,209,310 A 5/1993 Clydesdale
5,216,050 A 6/1993 Sinclair
5,219,380 A 6/1993 Young et al.
5,224,540 A 7/1993 Streich et al.
5,230,390 A 7/1993 Zastresek et al.
5,234,052 A 8/1993 Coone et al.
5,253,705 A 10/1993 Clary et al.
5,271,468 A * 12/1993 Streich et al. ..... 166/387
5,295,735 A 3/1994 Cobbs et al.
5,311,939 A 5/1994 Pringle et al.
5,316,081 A 5/1994 Baski et al.
5,318,131 A 6/1994 Baker
D350,887 S 9/1994 Sjolander et al.
5,343,954 A 9/1994 Bohlen et al.
D353,756 S 12/1994 Graves
D355,428 S 2/1995 Hatcher
5,390,737 A 2/1995 Jacobi et al.
5,392,540 A 2/1995 Cooper et al.
5,419,399 A 5/1995 Smith
RE35,088 E 11/1995 Gilbert
5,484,191 A 1/1996 Sollami
5,490,339 A 2/1996 Accettola
5,540,279 A 7/1996 Branch et al.
5,564,502 A 10/1996 Crow et al.
5,593,292 A 1/1997 Ivey et al.
D377,969 S 2/1997 Grantham
5,655,614 A 8/1997 Azar
5,688,586 A 11/1997 Shiiki et al.
5,701,959 A 12/1997 Hushbeck et al.
5,785,135 A 7/1998 Crawley
5,791,825 A 8/1998 Gardner et al.
5,803,173 A 9/1998 Fraser, III et al.
5,810,083 A 9/1998 Kilgore
5,819,846 A 10/1998 Bolt, Jr.
5,853,639 A 12/1998 Kawakami et al.
5,908,917 A 6/1999 Kawakami et al.
D415,180 S 10/1999 Rosanwo
5,961,185 A 10/1999 Friant et al.
5,984,007 A 11/1999 Yuan et al.
5,988,277 A 11/1999 Vick, Jr. et al.
6,001,439 A 12/1999 Kawakami et al.
6,012,519 A 1/2000 Allen et al.
6,046,251 A 4/2000 Kawakami et al.
6,082,451 A 7/2000 Giroux et al.
6,085,446 A 7/2000 Posch
6,098,716 A 8/2000 Hromas et al.
6,105,694 A 8/2000 Scott
6,142,226 A 11/2000 Vick
6,152,232 A 11/2000 Webb et al.
6,159,416 A 12/2000 Kawakami et al.
6,167,963 B1 1/2001 McMahan
6,182,752 B1 2/2001 Smith, Jr. et al.
6,183,679 B1 2/2001 Kawakami et al.
6,199,636 B1 3/2001 Harrison
6,220,349 B1 4/2001 Vargus et al.
6,245,437 B1 6/2001 Shiiki et al.
6,283,148 B1 9/2001 Spears et al.
6,341,823 B1 1/2002 Sollami
6,367,569 B1 4/2002 Walk
6,394,180 B1 5/2002 Berscheidt et al.
6,457,267 B1 10/2002 Porter et al.
6,491,108 B1 12/2002 Slup
6,543,963 B2 4/2003 Bruso
6,578,638 B2 6/2003 Guillory et al.
6,581,681 B1 6/2003 Zimmerman et al.
6,604,763 B1 8/2003 Cook et al.
6,629,563 B2 10/2003 Doane
6,673,403 B1 1/2004 Shiiki et al.

(56) References Cited

U.S. PATENT DOCUMENTS 6,695,049 B2 2/2004 Ostocke et al.
6,708,768 B2 3/2004 Slup et al.
6,708,770 B2 3/2004 Slup et al.
6,725,935 B2 4/2004 Szarka et al.
6,739,398 B1 5/2004 Yokley et al.
6,769,491 B2 8/2004 Zimmerman et al.
6,779,948 B2 8/2004 Bruso
6,796,376 B2 9/2004 Frazier
6,799,633 B2 10/2004 McGregor
6,834,717 B2 12/2004 Bland
6,851,489 B2 2/2005 Hinds
6,852,827 B2 2/2005 Yamane et al.
6,854,201 B1 2/2005 Hunter et al.
6,891,048 B2 5/2005 Yamane et al.
6,902,006 B2 6/2005 Myerley et al.
6,916,939 B2 7/2005 Yamane et al.
6,918,439 B2 7/2005 Dallas
6,938,696 B2 9/2005 Dallas
6,944,977 B2 9/2005 Deniau et al.
6,951,956 B2 10/2005 Yamane et al.
7,017,672 B2 * 3/2006 Owen, Sr. ..... 166/387
7,021,389 B2 4/2006 Bishop et al.
7,040,410 B2 5/2006 McGuire et al.
7,055,632 B2 6/2006 Dallas
7,069,997 B2 7/2006 Coyes et al.
7,107,875 B2 9/2006 Haugen et al.
7,124,831 B2 10/2006 Turley et al.
7,128,091 B2 10/2006 Istre, Jr.
7,150,131 B2 12/2006 Barker
7,168,494 B2 1/2007 Starr et al.
7,235,673 B2 6/2007 Yamane et al.
7,281,584 B2 10/2007 McGarian et al.
D560,109 S 1/2008 Huang
7,325,617 B2 2/2008 Murray
7,337,847 B2 3/2008 McGarian et al.
7,350,582 B2 4/2008 McKeachnie et al.
7,353,879 B2 4/2008 Todd et al.
7,363,967 B2 4/2008 Burris, II et al.
7,373,973 B2 5/2008 Smith et al.
7,389,823 B2 6/2008 Turley et al.
7,428,922 B2 9/2008 Fripp et al.
7,501,464 B2 3/2009 Sato et al.
7,527,104 B2 5/2009 Branch et al.
7,538,178 B2 5/2009 Sato et al.
7,538,179 B2 5/2009 Sato et al.
7,552,779 B2 6/2009 Murray
D597,110 S 7/2009 Anitua Aldecoa
7,600,572 B2 10/2009 Slup et al.
7,604,058 B2 10/2009 McGuire
7,622,546 B2 11/2009 Sato et al.
7,637,326 B2 12/2009 Bolding et al.
7,644,767 B2 1/2010 Kalb et al.
7,644,774 B2 1/2010 Branch et al.
D612,875 S 3/2010 Beynon
7,673,677 B2 3/2010 King et al.
7,690,436 B2 4/2010 Turley et al.
7,713,464 B2 5/2010 Nakajima et al.
D618,715 S 6/2010 Corcoran
7,728,100 B2 6/2010 Sato et al.
7,735,549 B1 6/2010 Nish et al.
7,740,079 B2 6/2010 Clayton et al.
7,775,286 B2 8/2010 Duphorne
7,775,291 B2 8/2010 Jacob
7,781,600 B2 8/2010 Ogawa et al.
7,784,550 B2 8/2010 Nutley et al.
7,785,682 B2 8/2010 Sato et al.
7,798,236 B2 9/2010 McKeachnie et al.
7,799,837 B2 9/2010 Yamane et al.
7,810,558 B2 10/2010 Shkurti et al.
7,812,181 B2 10/2010 Ogawa et al.
D629,820 S 12/2010 Van Ryswyk
7,866,396 B2 1/2011 Rytlewski
7,878,242 B2 2/2011 Gray
7,886,830 B2 2/2011 Bolding et al.
7,900,696 B1 3/2011 Nish et al.
7,909,108 B2 3/2011 Swor et al.
7,909,109 B2 3/2011 Angman et al.
D635,429 S 4/2011 Hakki
7,918,278 B2 4/2011 Barbee
7,921,923 B2 4/2011 McGuire
7,921,925 B2 4/2011 Maguire et al.
7,926,571 B2 4/2011 Hofman
7,976,919 B2 7/2011 Sato et al.
7,998,385 B2 8/2011 Yamane et al.
8,003,721 B2 8/2011 Suzuki et al.
8,039,548 B2 10/2011 Ogawa et al.
8,074,718 B2 12/2011 Roberts
8,079,413 B2 12/2011 Frazier
8,104,539 B2 1/2012 Stanojcic et al.
8,113,276 B2 2/2012 Greenlee et al.
8,119,699 B2 2/2012 Yamane et al.
8,127,856 B1 3/2012 Nish et al.
8,133,955 B2 3/2012 Sato et al.
D657,807 S 4/2012 Frazier
8,163,866 B2 4/2012 Sato et al.
8,230,925 B2 7/2012 Willberg et al.
8,231,947 B2 7/2012 Vaidya et al.
8,267,177 B1 * 9/2012 Vogel et al. ..... 166/317
8,293,826 B2 10/2012 Hokari et al.
8,304,500 B2 11/2012 Sato et al.
8,318,837 B2 11/2012 Sato et al.
8,362,158 B2 1/2013 Sato et al.
8,404,868 B2 3/2013 Yamane et al.
8,424,610 B2 4/2013 Newton et al.
8,459,346 B2 6/2013 Frazier
8,496,052 B2 7/2013 Frazier
2001/0040035 A1 11/2001 Appleton et al.
2003/0024706 A1 2/2003 Allamon
2003/0188860 A1 10/2003 Zimmerman et al.
2004/0150533 A1 8/2004 Hall et al.
2005/0173126 A1 8/2005 Starr et al.
2005/0175801 A1 8/2005 Yamane et al.
2006/0001283 A1 1/2006 Bakke
2006/0011389 A1 1/2006 Booth
2006/0047088 A1 3/2006 Yamane et al.
2006/0278405 A1 12/2006 Turley et al.
2007/0051521 A1 3/2007 Fike et al.
2007/0068670 A1 3/2007 Booth
2007/0107908 A1 5/2007 Vaidya et al.
2007/0151722 A1 7/2007 Lehr et al.
2007/0227745 A1 10/2007 Roberts et al.
2007/0240883 A1 10/2007 Telfer
2008/0060821 A1 3/2008 Smith et al.
2008/0110635 A1 5/2008 Loretz et al.
2009/0044957 A1 2/2009 Clayton et al.
2009/0081396 A1 3/2009 Hokari et al.
2009/0114401 A1 5/2009 Purkis
2009/0126933 A1 5/2009 Telfer
2009/0211749 A1 8/2009 Nguyen et al.
2010/0064859 A1 3/2010 Stephens
2010/0084146 A1 4/2010 Roberts
2010/0093948 A1 4/2010 Sato et al.
2010/0101807 A1 4/2010 Greenlee et al.
2010/0132960 A1 6/2010 Shkurti et al.
2010/0155050 A1 6/2010 Frazier
2010/0184891 A1 7/2010 Akutsu et al.
2010/0215858 A1 8/2010 Yamane et al.
2010/0252252 A1 10/2010 Harris et al.
2010/0263876 A1 10/2010 Frazier
2010/0276159 A1 11/2010 Mailand et al.
2010/0286317 A1 11/2010 Sato et al.
2010/0288503 A1 11/2010 Cuiper et al.
2011/0005779 A1 1/2011 Lembcke
2011/0008578 A1 1/2011 Yamane et al.
2011/0027590 A1 2/2011 Abe
2011/0036564 A1 2/2011 Williamson
2011/0061856 A1 3/2011 Kellner et al.
2011/0088915 A1 4/2011 Stanojcic et al.
2011/0103915 A1 5/2011 Tedeschi
2011/0104437 A1 5/2011 Yamamura et al.
2011/0108185 A1 5/2011 Hokari et al.
2011/0168404 A1 7/2011 Telfer et al.
2011/0190456 A1 8/2011 Itoh et al.
2011/0198082 A1 8/2011 Stromquist et al.

(56) References Cited

U.S. PATENT DOCUMENTS

| | | | |
|---|---|---|---|
| 2011/0240295 | A1 | 10/2011 | Porter et al. |
| 2011/0259610 | A1 | 10/2011 | Shkurti et al. |
| 2011/0263875 | A1 | 10/2011 | Suzuki et al. |
| 2012/0046414 | A1 | 2/2012 | Sato et al. |
| 2012/0086147 | A1 | 4/2012 | Sato et al. |
| 2012/0125642 | A1 | 5/2012 | Chenault et al. |
| 2012/0130024 | A1 | 5/2012 | Sato et al. |
| 2012/0156473 | A1 | 6/2012 | Suzuki et al. |
| 2012/0193835 | A1 | 8/2012 | Suzuki et al. |
| 2012/0270048 | A1 | 10/2012 | Saigusa et al. |
| 2012/0289713 | A1 | 11/2012 | Suzuki et al. |
| 2013/0079450 | A1 | 3/2013 | Sato et al. |
| 2013/0081801 | A1 | 4/2013 | Liang et al. |
| 2013/0081813 | A1 | 4/2013 | Liang et al. |
| 2013/0087061 | A1 | 4/2013 | Marya et al. |

FOREIGN PATENT DOCUMENTS

| | | |
|---|---|---|
| WO | WO02070508 | 12/2002 |
| WO | WO03006525 | 1/2003 |
| WO | WO03006526 | 1/2003 |
| WO | WO03074092 | 9/2003 |
| WO | WO03090438 | 10/2003 |
| WO | WO03099562 | 12/2003 |
| WO | WO2004033527 | 4/2004 |
| WO | WO03037956 | 5/2004 |
| WO | WO2005044894 | 5/2005 |
| WO | WO2006064611 | 1/2006 |
| WO | WO2010127457 | 11/2010 |

OTHER PUBLICATIONS

"78/79 Catalog: Packers-Plugs-Completions Tools," Pengo Industires, Inc., 1978-1979 (12 pages).
"MAP Oil Tools Inc. Catalog," MAP Oil Tools, Apr. 1999 (46 pages).
"Lovejoy-where the world turns for couplings," Lovejoy, Inc., Dec. 2000 (30 pages).
"Halliburton Services, Sales & Service Catalog," Halliburton Services, 1970-1971 (2 pages).
"1975-1976 Packer Catalog," Gearhart-Owen Industries Inc., 1975-1976 (52 pages).
"Formation Damage Control Utilizing Composite-Bridge Plug Technology for Monobore, Multizone Stimulation Operations," Gary Garfield, SPE, May 15, 2001 (8 pages).
"Composite Bridge Plug Technique for Multizone Commingled Gas Wells," Gary Garfield, SPE, Mar. 24, 2001 (6 pages).
"Composite Research: Composite bridge plugs used in multi-zone wells to avoid costly kill-weight fluids," Gary Garfield, SPE, Mar. 24, 2001 (4 pages).
"It's About Time-Quick Drill Composite Bridge Plug," Baker Oil Tools, Jun. 2002 (2 pages).
"Baker Hughes-Baker Oil Tools-Workover Systems-QUIK Drill Composite Bride Plug," Baker Oil Tools, Dec. 2000 (3 pages).
"Baker Hughes 100 Years of Service,"Baker Hushes in Depth, Special Centennial Issue, Publication COR-07-13127, vol. 13, No. 2, Baker Hughes Incorporated, Jul. 2007 (92 pages).
"Halliburton Services, Sales & Service Catalog No. 43," Halliburton Co., 1985 (202 pages).
"Alpha Oil Tools Catalog," Alpha Oil Tools, 1997 (136 pages).
Petition for Inter Partes Review for U.S. Patent No. 8,079,413 (U.S. Appl. No. 13/194,871); Case No. 2013-00231; Filed Apr. 2, 2013; Administrative Patent Judge Sally C. Medley.
Petition for Inter Partes Review for U.S. Patent No. 8,079,413 (U.S. Appl. No. 13/194,871); Case No. 2013-00231; Filed Apr. 2, 2013; Administrative Patent Judge Sally C. Medley; Paper No. 31, Final Written Decision entered Sep. 2, 2014.
Petition for Inter Partes Review for U.S. Patent No. 8,079,413 (U.S. Appl. No. 13/194,871); Case No. 2013-00231; Filed Apr. 2, 2013; Administrative Patent Judge Sally C. Medley; Paper No. 33, Decision on Request for Rehearing entered Oct. 29, 2014.
Petition for Inter Partes Review for U.S. Patent No. 8,079,413 (U.S. Appl. No. 13/194,871); Case No. 2013-00231; Filed Apr. 2, 2013; Administrative Patent Judge Sally C. Medley; Paper No. 35, Notice of Appeal entered Dec. 23, 2014.
Petition for Inter Partes Review for U.S. Patent No. 8,459,346 (U.S. Appl. No. 13/329,077); Case No. 2014-00993; Filed Jun. 19, 2014; Administrative Patent Judge Sally C. Medley; Paper No. 14, Decision to Institute Trial entered Dec. 1, 2014.
Petition for Inter Partes Review for U.S. Patent No. 8,459,346 (U.S. Appl. No. 13/329,077); Case No. 2014-00993; Filed Jun. 19, 2014; Administrative Patent Judge Sally C. Medley; Paper No. 18, Termination of the Proceeding entered Dec. 11, 2014.

* cited by examiner

CONFIGURABLE BRIDGE PLUGS AND METHODS FOR USING SAME

CROSS-REFERENCE TO RELATED APPLICATIONS

This application is a continuation-in-part of U.S. patent application having Ser. No. 12/799,231, filed Apr. 21, 2010, which claims priority to U.S. Provisional Patent Application having Ser. No. 61/214,347, filed Apr. 21, 2009, in the entirety of which are both incorporated by reference herein.

BACKGROUND

1. Field

Embodiments described generally relate to downhole tools. More particularly, embodiments described relate to an insert that can be engaged in downhole tools for controlling fluid flow through one or more zones of a wellbore.

2. Description of the Related Art

Bridge plugs, packers, and frac plugs are downhole tools that are typically used to permanently or temporarily isolate one wellbore zone from another. Such isolation is often necessary to pressure test, perforate, frac, or stimulate a zone of the wellbore without impacting or communicating with other zones within the wellbore. To reopen and/or restore fluid communication through the wellbore, plugs are typically removed or otherwise compromised.

Permanent, non-retrievable plugs and/or packers are typically drilled or milled to remove. Most non-retrievable plugs are constructed of a brittle material such as cast iron, cast aluminum, ceramics, or engineered composite materials, which can be drilled or milled. Problems sometimes occur, however, during the removal or drilling of such non-retrievable plugs. For instance, the non-retrievable plug components can bind upon the drill bit, and rotate within the casing string. Such binding can result in extremely long drill-out times, excessive casing wear, or both. Long drill-out times are highly undesirable, as rig time is typically charged by the hour.

In use, non-retrievable plugs are designed to perform a particular function. A bridge plug, for example, is typically used to seal a wellbore such that fluid is prevented from flowing from one side of the bridge plug to the other. On the other hand, drop ball plugs allow for the temporary cessation of fluid flow in one direction, typically in the downhole direction, while allowing fluid flow in the other direction. Depending on user preference, one plug type may be advantageous over another, depending on the completion and/or production activity.

Certain completion and/or production activities may require several plugs run in series or several different plug types run in series. For example, one well may require three bridge plugs and five drop ball plugs, and another well may require two bridge plugs and ten drop ball plugs for similar completion and/or production activities. Within a given completion and/or production activity, the well may require several hundred plugs and/or packers depending on the productivity, depths, and geophysics of each well. The uncertainty in the types and numbers of plugs that might be required typically leads to the over-purchase and/or under-purchase of the appropriate types and numbers of plugs resulting in fiscal inefficiencies and/or field delays.

There is a need, therefore, for a downhole tool that can effectively seal the wellbore at wellbore conditions; be quickly, easily, and/or reliably removed from the wellbore; and configured in the field to perform one or more functions.

BRIEF DESCRIPTION OF THE DRAWINGS

Non-limiting, illustrative embodiments are depicted in the drawings, which are briefly described below. It is to be noted, however, that these illustrative drawings illustrate only typical embodiments and are not to be considered limiting of its scope, for the invention can admit to other equally effective embodiments.

FIG. 9 depicts an illustrative, complementary set of angled surfaces that function as anti-rotation features adapted to interact and/or engage between a first plug and a second plug in series, according to one or more embodiments described.

FIG. 10 depicts an illustrative, dog clutch anti-rotation feature, allowing a first plug and a second plug to interact and/or engage in series, according to one or more embodiments described.

FIG. 11 depicts an illustrative, complementary set of flats and slots that serve as anti-rotation features to interact and/or engage between a first plug and a second plug in series, according to one or more embodiments described.

FIG. 12 depicts another illustrative, complementary set of flats and slots that serve as anti-rotation features to interact and/or engage between a first plug and a second plug in series, according to one or more embodiments described.

DETAILED DESCRIPTION

An insert for use in a downhole plug is provided. The insert can include one or more upper shear or shearable mechanisms below a connection to a setting tool, and/or an insert for controlling fluid flow. The upper shear or shearable mechanism can be located directly on the first insert or on a separate component or second insert that is placed within the first insert. The upper shear or shearable mechanism is adapted to release a setting tool when exposed to a predetermined axial force that is sufficient to deform the shearable mechanism to release the setting tool but is less than an axial force sufficient to break the plug body. The terms "shear mechanism" and "shearable mechanism" are used interchangeably, and are intended to refer to any component, part, element, member, or thing that shears or is capable of shearing at a predetermined force that is less than the force required to shear the body of the plug. The term "shear" means to fracture, break, or otherwise deform thereby releasing two or more engaged components, parts, or things or thereby partially or fully separating a single component into two or more components/pieces. The term "plug" refers to any tool used to permanently or temporarily isolate one wellbore zone from another, including any tool with blind passages, plugged mandrels, as well as open passages extending completely therethrough and passages that are blocked with a check valve. Such tools are commonly referred to in the art as "bridge plugs," "frac plugs," and/or "packers." And, such tools can be a single assembly (i.e., one plug) or two or more assemblies (i.e., two or more plugs) disposed within a work string or otherwise connected thereto that is run into a wellbore on a wireline, slickline, production tubing, coiled tubing or any technique known or yet to be discovered in the art.

Further, a method for operating a wellbore is provided. The method can include operating the wellbore by setting one or more configurable plugs within the wellbore, with or without additionally using an insert to provide restricted fluid flow throughout the plug for a predetermined length of time.

Figure 1:
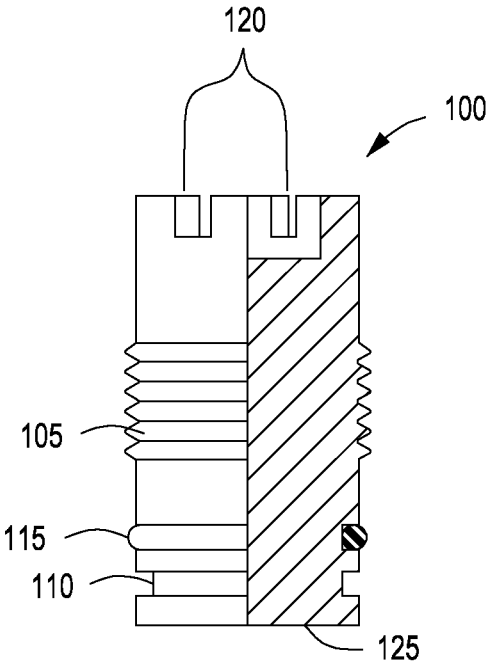
FIG. 1 depicts a partial section view of an illustrative insert for use with a plug for downhole use, according to one or more embodiments described.

FIG. 1 depicts a partial section view of an illustrative, insert 100 for a plug, according to one or more embodiments. The insert 100 can include a first or upper end 102 and a second or lower end 125. One or more threads 105 can be disposed or formed on an outer surface of the insert 100. The threads 105 can be disposed on the outer surface of the insert 100 toward the upper end 102. As discussed in more detail below with reference to FIGS. 6A, 6B, 6C, and 6D the threads 105 can be used to secure the insert 100 within a surrounding component, such as another insert 100, setting tool, tubing string, plug, or other tool.

Any number of outer threads 105 can be used. The number, pitch, pitch angle, and/or depth of outer threads 105 can depend at least in part, on the operating conditions of the wellbore where the insert 100 will be used. The number, pitch, pitch angle, and/or depth of the outer threads 105 can also depend, at least in part, on the materials of construction of both the insert 100 and the component, e.g., another insert 100, a setting tool, another tool, plug, tubing string, etc., to which the insert 100 is connected. The number of threads 105, for example, can range from about 2 to about 100, such as about 2 to about 50; about 3 to about 25; or about 4 to about 10. The number of threads 105 can also range from a low of about 2, 4, or 6 to a high of about 7, 12, or 20. The pitch between each thread 105 can also vary. The pitch between each thread 105 can be the same or different. For example, the pitch between each thread 105 can vary from about 0.1 mm to about 200 mm; 0.2 mm to about 150 mm; 0.3 mm to about 100 mm; or about 0.1 mm to about 50 mm. The pitch between each thread 105 can also range from a low of about 0.1 mm, 0.2 mm, or 0.3 mm to a high of about 2 mm, 5 mm or 10 mm.

The threads 105 can be right-handed and/or left-handed threads. For example, to facilitate connection of the insert 100 to a plug when the insert 100 is coupled to, for example, screwed into the plug, the threads 105 can be right-handed threads and the plug threads can be left-handed threads, or vice versa.

The outer surface of the insert 100 can have a constant diameter, or its diameter can vary (not shown). For example, the outer surface can include a smaller first diameter portion or area that transitions to a larger, second diameter portion or area, forming a ledge or shoulder therebetween. The shoulder can have a first end that is substantially flat, abutting the second diameter, a second end that gradually slopes or transitions to the first diameter, and can be adapted to anchor the insert 100 into the plug. The shoulder can be formed adjacent the outer threads 105 or spaced apart therefrom, and the outer threads 105 can be above or below the shoulder.

The insert 100 can include one or more channels 110 disposed or otherwise formed on an outer surface thereof. The one or more channels 110 can be disposed on the outer surface of the insert 100 toward a lower end 125 of the insert 100. A sealing material 115, such as an elastomeric O-ring, can be disposed within the one or more channels 110 to provide a fluid seal between the insert and the plug with which the insert can be engaged. Although the outer surface or outer diameter of the lower end 125 of the configurable insert 100 is depicted as being uniform, the outer surface or diameter of the lower end 125 can be tapered.

The top of the upper end 102 of the configurable insert 100 can include an upper surface interface 120 for engaging one or more tools to locate and tighten the configurable insert 100 onto the plug. The upper surface interface 120 can be, without limitation, hexagonal, slotted, notched, cross-head, square, torx, security torx, tri-wing, torq-set, spanner head, triple square, polydrive, one-way, spline drive, double hex, Bristol, Pentalobular, or other known surface shape capable of being engaged.

Figure 2:
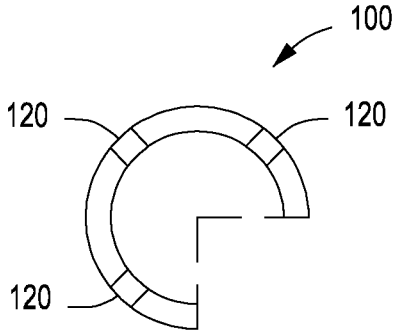
FIG. 2 depicts a top view of the illustrative insert of FIG. 1, according to one or more embodiments described.

FIG. 2 depicts a top plan view of the illustrative insert of FIG. 1, according to one or more embodiments described. As configured, the insert 100 of FIGS. 1 and 2 can be adapted to prevent fluid flow fluid flow in all directions through the insert 100.

Figure 3:
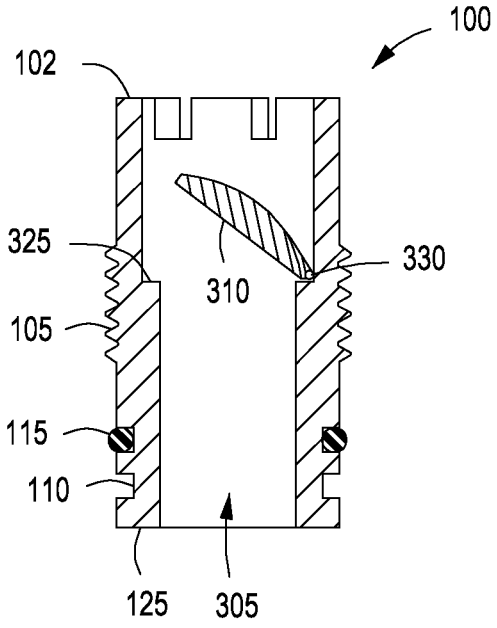
FIG. 3 depicts a partial section view of another illustrative embodiment of the insert for use with a plug for downhole use, according to one or more embodiments described.

FIG. 3 depicts a partial section view of another illustrative embodiment of the insert 100, according to one or more embodiments. A passageway or bore 305 can be completely or at least partially formed through the insert 100 to allow fluid flow in at least one direction therethrough. The bore 305 of the insert 100 can have a constant diameter, or the diameter can vary. For example, the bore can include a smaller first diameter portion or area that transitions to a larger, second diameter portion or area to form a ledge or shoulder 325 therebetween. The shoulder 325 can have a first end that is substantially flat, abutting the second diameter portion or area, and a second end that gradually slopes or transitions to the first diameter portion or area. The shoulder 325 can be adapted to receive a flapper valve member 310 that can be contained within the bore 305 using a pivot pin 330. Although not shown, the insert 100 can be further adapted to include a tension member that can urge the flapper valve member 310 into either an open or closed position, as discussed in more detail below.

Figure 4A:
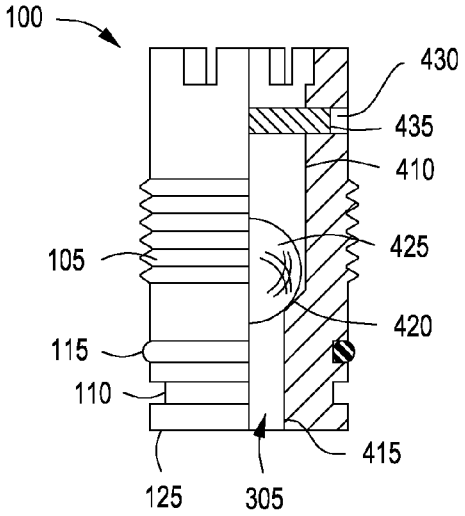
FIG. 4A depicts a partial section view of another illustrative embodiment of the insert for use with a plug for downhole use, according to one or more embodiments described.

FIG. 4A depicts a partial section view of another illustrative embodiment of the insert 100, according to one or more embodiments. The bore 305 of the insert 100 can have a constant diameter, or the diameter can vary. For example, the bore 305 can include a smaller first diameter portion or area 415 that transitions to a larger, second diameter portion or area 410 to form a ledge or shoulder 420 therebetween. The shoulder 420 can have a first end that is substantially flat, abutting the second diameter portion or area, and a second end that gradually slopes or transitions to the first diameter portion or area. The shoulder 420 can be adapted to receive a solid impediment, such as a ball 425, which can be contained within the bore 305 using a pin 435 that can be inserted into an aperture 430 of the insert 100. The pin 435 restricts movement of the ball 425 to within the length of the bore 305 between the shoulder 420 and the pin 435. In such a configuration, the ball 425 permits fluid flow from the direction of the lower end 125; however, fluid flow is restricted or prevented from the direction of the upper end 102 when the ball 425 seats at the shoulder 420, creating a fluid seal. The pin 434 prevents the ball 425 from escaping the bore 305 when fluid is moving from the direction of the lower end 125 of the insert 100.

Figure 4B:
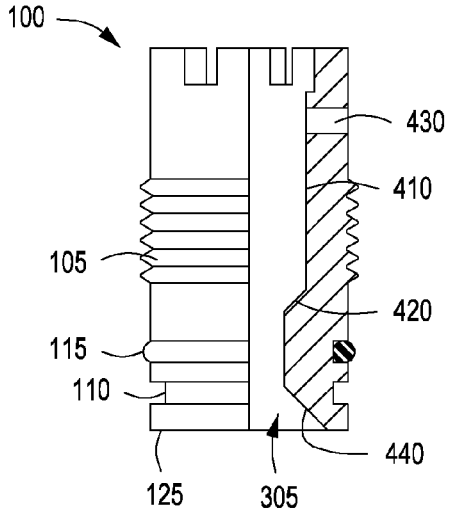
FIG. 4B depicts a partial section view of another illustrative embodiment of the insert for use with a plug for downhole use, according to one or more embodiments described.

FIG. 4B depicts a partial section view of another illustrative insert 100, according to one or more embodiments. The bore 305 of the insert 100 can have a varying diameter, for example, the bore 305 of the insert 100 can include a smaller diameter portion or area 410 that transitions to a larger diameter portion or area forming a seat or shoulder 420, and at least one or more additional portion or area that transitions to at least one smaller diameter portion or area, forming at least one seat or shoulder therein. For example, a second seat or shoulder 440 can be formed towards the lower end 125 of the insert 100 in a transition between a smaller diameter portion or area and a larger diameter portion or area. The shoulder 440 can accept a solid impediment, e.g., a ball to prevent fluid flow upwardly through the bore 305, as the ball makes a fluid seal against the shoulder 440.

Figure 5:
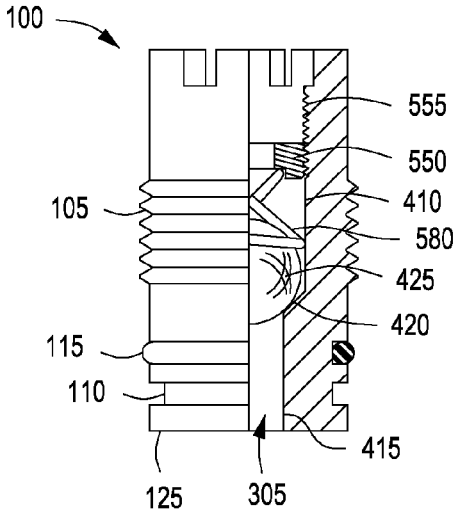
FIG. 5 depicts a partial section view of another illustrative embodiment of the insert for use with a plug for downhole use, according to one or more embodiments described.

FIG. 5 depicts a partial section view of another illustrative embodiment of the insert 100, according to one or more embodiments. The insert 100 can include one or more inner threads 555 disposed on an inner surface of the bore 305 to couple, for example, screw into the insert 100 to another insert 100, a setting tool, another downhole tool, plug, tubing string, or impediment for restricting fluid flow. The threads 555 can be located toward, near, or at an upper end 102 of the insert 100. In one or more embodiments, the inner threads can engage an impediment, such as a ball stop 550 and a ball 425 received in the bore 305, as shown. The ball stop 550 can be coupled in the bore 305 via the threads 555, such that the ball stop 550 can be easily inserted in the field, for example. Further, the ball stop 550 can be configured to retain the ball 425 in the bore 305 between the ball stop 550 and the shoulder 420. The ball 425 can be shaped and sized to provide a fluid tight seal against the seat or shoulder 420, 440 to restrict fluid movement through the bore 305 in the insert 100. However, the ball 425 need not be entirely spherical, and can be provided as any size and shape suitable to seat against the seat or shoulder 420, 440.

Accordingly, the ball stop 550 and the ball 425 provide a one-way check valve. As such, fluid can generally flow from the lower end 125 of the insert 100 to and out through the upper end 102, thereof; however, the bore 305 may be sealed from fluid flowing from the upper end 102 of the insert 100 to the lower end 125. The ball stop 550 can be a plate, annular cover, a ring, a bar, a cage, a pin, or other component capable of preventing the ball 425 from moving past the ball stop 550 in the direction towards the upper end 102 of the insert 100. Further, the ball stop 550 can retain a tension member 580, such as a spring, to urge the solid impediment or ball 425 to more tightly seal against the seat or shoulder 420 of the insert 100.

The insert 100 or at least the threads 105, 555 can be made of an alloy that includes brass. Suitable brass compositions include, but are not limited to, admiralty brass, Aich's alloy, alpha brass, alpha-beta brass, aluminum brass, arsenical brass, beta brass, cartridge brass, common brass, dezincification resistant brass, gilding metal, high brass, leaded brass, lead-free brass, low brass, manganese brass, Muntz metal, nickel brass, naval brass, Nordic gold, red brass, rich low brass, tonval brass, white brass, yellow brass, and/or any combinations thereof.

The insert 100 can also be formed or made from other metallic materials (such as aluminum, steel, stainless steel, copper, nickel, cast iron, galvanized or non-galvanized metals, etc.), fiberglass, wood, composite materials (such as ceramics, wood/polymer blends, cloth/polymer blends, etc.), and plastics (such as polyethylene, polypropylene, polystyrene, polyurethane, polyethylethylketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer) polynitrile resins (such as polyacrylonitrile (PAN), polymethacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like)), as well as mixtures, blends, and copolymers of any and all of the foregoing materials.

Figure 6A:
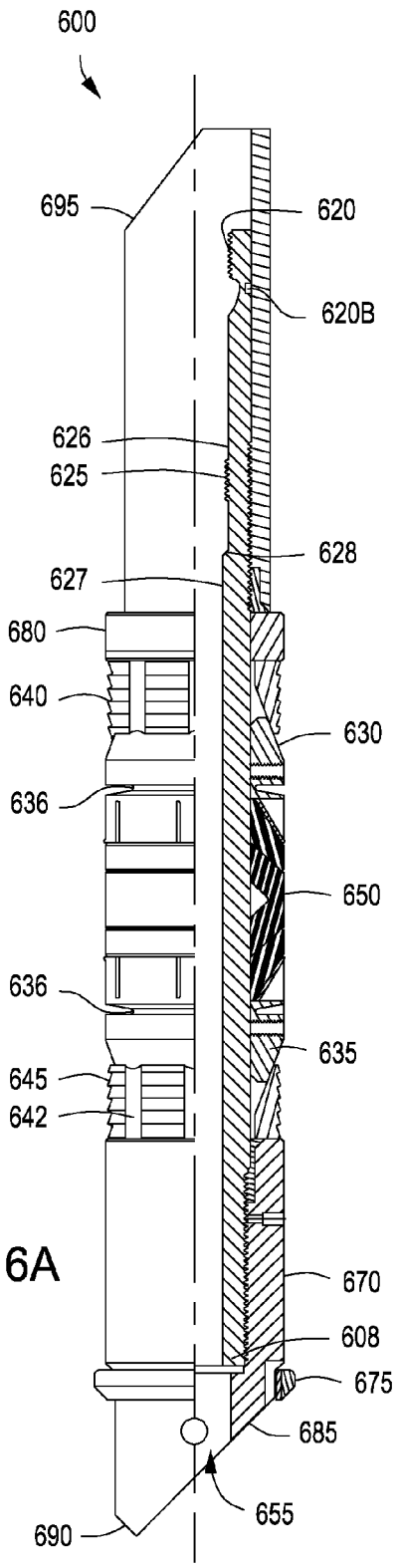
FIG. 6A depicts a partial section view of an illustrative plug for downhole use configured without an insert, according to one or more embodiments described.

FIG. 6A depicts a partial section view of an illustrative plug 600 configured without an insert 100, according to one or more embodiments. The plug 600 can include a mandrel or body 608, wherein a passageway or bore 655 can be formed at least partially through the body 608. The body 608 can be a single, monolithic component as shown, or the body 608 can be or include two or more components connected, engaged, or otherwise attached together. The body 608 serves as a centralized support member, made of one or more components or parts, for one or more outer components to be disposed thereon or thereabout.

The bore 655 can have a constant diameter throughout, or the diameter can vary, as depicted in FIGS. 6A, 6B, 6C and 6D. For example, the bore 655 can include a larger, first diameter portion or area 625 that transitions to a smaller, second diameter portion or area 627, forming a seat or shoulder 628 therebetween. The shoulder 628 can have a tapered or sloped surface connecting the two diameters portions or areas 625, 627. Although not shown, the shoulder 628 can be flat or substantially flat, providing a horizontal or substantially horizontal surface connecting the two diameters 625, 627. As will be explained in more detail below, the shoulder 628 can serve as a seat or receiving surface for plugging off the bore 655 when an insert 100, such as depicted in FIG. 1, or other solid object is coupled, for example, screwed into or otherwise placed within the bore 655.

A setting tool, tubing string, plug, or other tool can be coupled with and/or disposed within the body 608 above the shoulder 628. In one or more embodiments, a shear mechanism 620 can be sheared, fractured, or otherwise deformed, releasing the setting tool, tubing string, plug, or other tool from the plug 600.

At least one conical member (two are shown: 630, 635), at least one slip (two are shown: 640, 645), and at least one malleable element 650 can be disposed about the body 608. As used herein, the term "disposed about" means surrounding the component, e.g., the body 608, allowing for relative movement therebetween (e.g., by sliding, rotating, pivoting, or a combination thereof). A first section or second end of the conical members 630, 635 a sloped surface adapted to rest underneath a complementary sloped inner surface of the slips 640, 645. As explained in more detail below, the slips 640, 645 travel about the surface of the adjacent conical members 630, 635, thereby expanding radially outward from the body 608 to engage an inner surface of a surrounding tubular or borehole. A second section or second end of the conical members 630, 635 can include two or more tapered petals or wedges adapted to rest about an adjacent malleable element 650. One or more circumferential voids 636 can be disposed within or between the first and second sections of the conical members 630, 635 to facilitate expansion of the wedges about the malleable element 250. The wedges are adapted to hinge or pivot radially outward and/or hinge or pivot circumferentially. The groove or void 636 can facilitate such movement. The wedges pivot, rotate, or otherwise extend radially outward, and can contact an inner diameter of the surrounding tubular or borehole. Additional details of the conical members 630, 635 are described in U.S. Pat. No. 7,762,323.

The inner surface of each slip 640, 645 can conform to the first end of the adjacent conical member 630, 635. An outer surface of the slips 640, 645 can include at least one outwardly-extending serration or edged tooth to engage an inner surface of a surrounding tubular, as the slips 640, 645 move radially outward from the body 608 due to the axial movement across the adjacent conical members 630, 635.

The slips 640, 645 can be designed to fracture with radial stress. The slips 640, 645 can include at least one recessed groove 642 milled or otherwise formed therein to fracture under stress allowing the slips 640, 645 to expand outward and engage an inner surface of the surrounding tubular or borehole. For example, the slips 640, 645 can include two or more, for example, four, sloped segments separated by equally-spaced recessed grooves 642 to contact the surrounding tubular or borehole.

The malleable element 650 can be disposed between the conical members 630, 635. A three element 650 system is depicted in FIGS. 6A, 6B, 6C, 6D, 7 and 8; but any number of elements 650 can be used. The malleable element 650 can be constructed of any one or more malleable materials capable of expanding and sealing an annulus within the wellbore. The malleable element 650 is preferably constructed of one or more synthetic materials capable of withstanding high temperatures and pressures, including temperatures up to 450° F., and pressure differentials up to 15,000 psi. Illustrative materials include elastomers, rubbers, TEFLON®, blends and combinations thereof.

The malleable element(s) 650 can have any number of configurations to effectively seal the annulus defined between the body 608 and the wellbore. For example, the malleable element(s) 650 can include one or more grooves, ridges, indentations, or protrusions designed to allow the malleable element(s) 650 to conform to variations in the shape of the interior of the surrounding tubular or borehole.

At least one component, ring or other annular member 680 for receiving an axial load from a setting tool can be disposed about the body 608 adjacent a first end of the slip 640. The annular member 680 for receiving the axial load can have first and second ends that are substantially flat. The first end can serve as a shoulder adapted to abut a setting tool (not shown). The second end can abut the slip 640 and transmit axial forces therethrough.

Each end of the plug 600 can be the same or different. Each end of the plug 600 can include one or more anti-rotation features 670, disposed thereon. Each anti-rotation feature 670 can be screwed onto, formed thereon, or otherwise connected to or positioned about the mandrel 608 so that there is no relative motion between the anti-rotation feature 670 and the mandrel 608. Alternatively, each anti-rotation feature 670 can be screwed onto or otherwise connected to or positioned about a shoe, nose, cap, or other separate component, which can be made of composite, that is screwed onto threads, or otherwise connected to or positioned about the mandrel 608 so that there is no relative motion between the anti-rotation feature 670 and the mandrel 608. The anti-rotation feature 670 can have various shapes and forms. For example, the anti-rotation feature 670 can be or can resemble a mule shoe shape (not shown), half-mule shoe shape (illustrated in FIG. 9), flat protrusions or flats (illustrated in FIGS. 11 and 12), clutches (illustrated in FIG. 10), or otherwise angled surfaces 685, 690, 695 (illustrated in FIGS. 6A, 6B, 6C, 6D, 7, 8 and 9).

As explained in more detail below, the anti-rotation features 670 are intended to engage, connect, or otherwise contact an adjacent plug, whether above or below the adjacent plug, to prevent or otherwise retard rotation therebetween, facilitating faster drill-out or mill times. For example, the angled surfaces 685, 690 at the bottom of the first plug 600 can engage the sloped surface 695 of a second plug 600 in series, so that relative rotation therebetween is prevented or greatly reduced.

A pump down collar 675 can be located about a lower end of the plug 600 to facilitate delivery of the plug 600 into the wellbore. The pump down collar 675 can be a rubber O-ring or similar sealing member to create an impediment in the wellbore during installation, so that a push surface or resistance can be created.

Figure 6B:
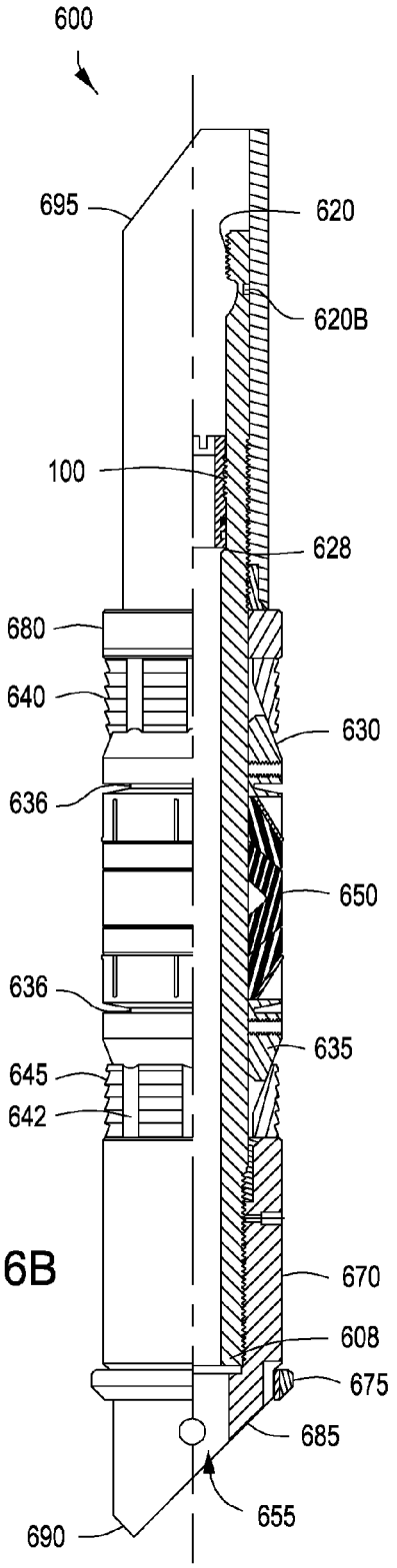
FIG. 6B depicts a partial section view of another illustrative embodiment of the plug for downhole use configured with the insert, according to one or more embodiments described.

FIG. 6B depicts a partial section view of another illustrative plug 600 configured with the insert 100, for regulating flow through the bore 655, according to one or more embodiments. The insert 100 can be coupled, for example, screwed in via threads 625 or otherwise disposed within the plug 600. A setting tool, tubing string, plug, or other tool can be threaded or otherwise disposed on the plug 600 above at or above the insert 100. In one or more embodiments, the mandrel or body 608 can be sheared, fractured, or otherwise deformed, releasing the setting tool, tubing string, plug, or other tool from the plug 600. After the setting tool is removed from the plug 600, the insert 100 may remain engaged with the plug 600.

The insert 100 can be adapted to receive or have an impediment formed thereon restricting or preventing fluid flow in at least one direction. The impediment can include any solid flow control component known or yet to be discovered in the art, such as a ball 425 (depicted in FIGS. 4A, 4B and 5) or a flapper assembly. The flapper assembly can include a flapper member 310 (depicted in FIG. 3) connected to the insert 100 using one or more pivot pins 330. The flapper member 310 can be flat or substantially flat. Alternatively, the flapper member 310 can have an arcuate shape, with a convex upper surface and a concave lower surface. A spring or other tension member (not shown) can be disposed about the one or more pivot pins 330 to urge the flapper member 310 from a run-in ("first" or "open") position wherein the flapper member 310 does not obstruct the bore 655 through the plug 600, to an operating ("second" or "closed") position (not shown), where the flapper member 310 assumes a position proximate to the shoulder or valve seat 325, transverse to the bore 655 of the plug 600. At least a portion of the spring can be disposed upon or across the upper surface of the flapper member 310 providing greater contact between the spring and the flapper member 310, offering greater leverage for the spring to displace the flapper member 310 from the run-in position to the operating position. In the run-in position, bi-directional, e.g., upward and downward or side to side, fluid communication through the plug 600 can occur. In the operating position, unidirectional, e.g., upward as shown, fluid communication through the plug 600 can occur.

As used herein the term "arcuate" refers to any body, member, or thing having a cross-section resembling an arc. For example, a flat, elliptical member with both ends along the major axis turned downwards by a generally equivalent amount can form an arcuate member. The terms "up" and "down"; "upward" and "downward"; "upper" and "lower"; "upwardly" and "downwardly"; "upstream" and "downstream"; "above" and "below"; and other like terms as used herein refer to relative positions to one another and are not intended to denote a particular spatial orientation since the tool and methods of using same can be equally effective in either horizontal or vertical wellbore uses. Additional details of a suitable flapper assembly can be found in U.S. Pat. No. 7,708,066, which is incorporated by reference herein in its entirety.

Figure 6C:
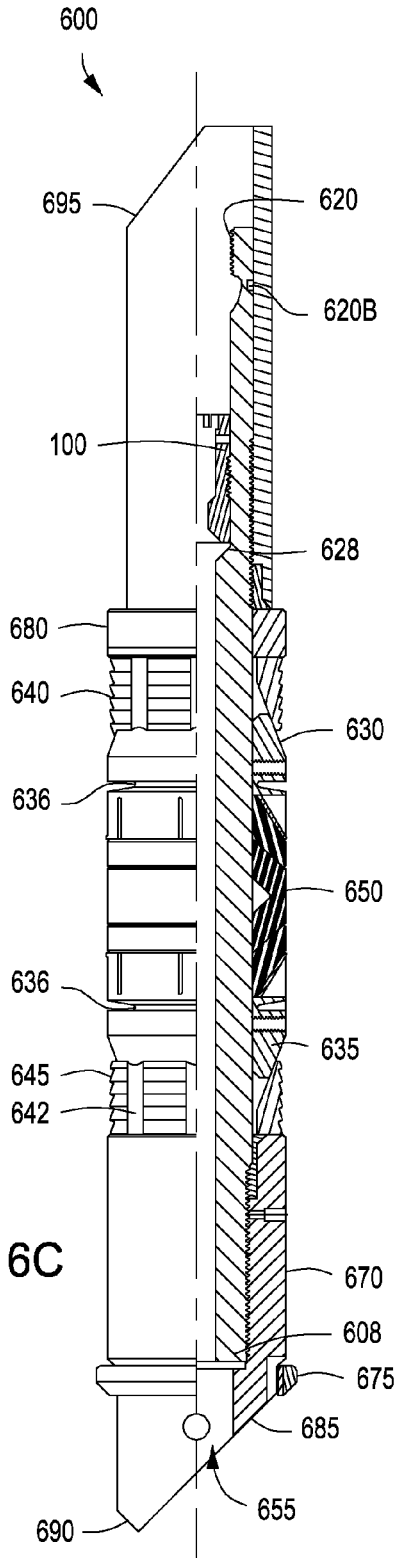
FIG. 6C depicts a partial section view of another illustrative plug for downhole use configured with the insert, according to one or more embodiments described.
Figure 6D:
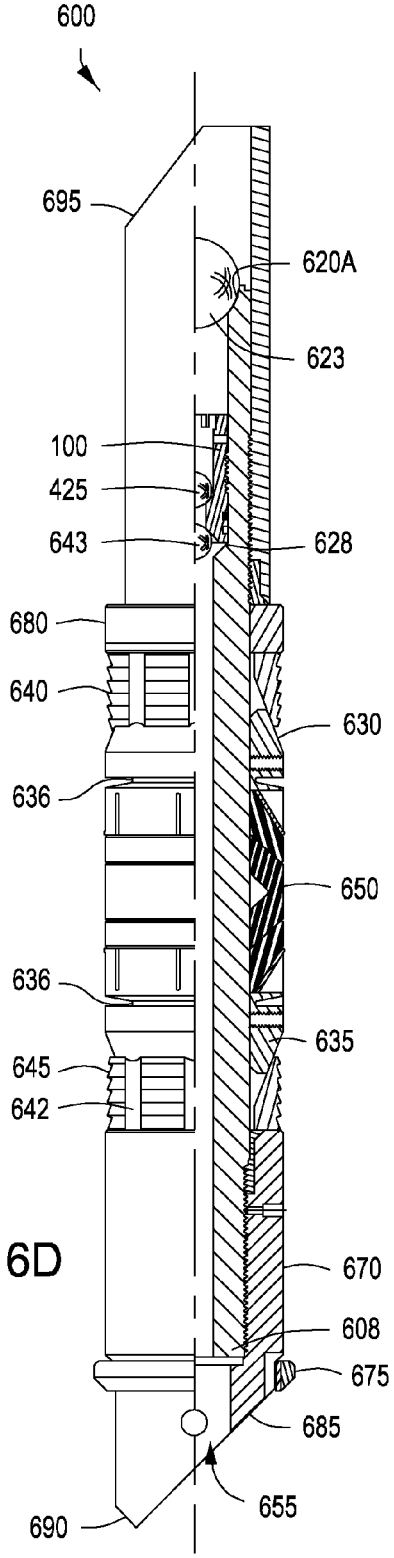
FIG. 6D depicts a partial section view of another illustrative plug for downhole use configured with the insert after a setter tool has been removed, according to one or more embodiments described.

FIGS. 6C and 6D depict partial section views of illustrative plugs 600 configured with the insert 100, for regulating flow through the bore 655, according to one or more embodiments. Prior to installing insert 100 into the wellbore, a ball 643 can be inserted into the bore 655 of the plug 600, as shown in FIG. 6D. A retaining pin or a washer can be installed into the plug 600 prior to the ball 643 to prevent the ball 643 from escaping the bore 655. According, the insert 100 can be installed in the plug 600 prior to installing the plug 600 into the wellbore. In this embodiment, shown in FIG. 6D, the ball 643 can prevent fluid flow from the lower end of the bore 655 toward the upper end of the bore 655, forming a fluid tight seal against seat 440 of the insert 100 in the plug 600 (shown in FIG. 4B). Additionally, the drop ball 425 can be used prior to or after installation of the plug 600 into the wellbore to regulate fluid flow in the direction from the upper end of the plug 100 through the bore 655 toward the lower end of the plug 600.

The plug 600 can be installed in a vertical, horizontal, or deviated wellbore using any suitable setting tool adapted to engage the plug 600. One example of such a suitable setting tool or assembly includes a gas operated outer cylinder powered by combustion products and an adapter rod. The outer cylinder of the setting tool abuts an outer, upper end of the plug 600, such as against the annular member 680. The outer cylinder can also abut directly against the upper slip 640, for example, in embodiments of the plug 600 where the annular member 680 is omitted, or where the outer cylinder fits over or otherwise avoids bearing on the annular member 680. The adapter rod is threadably connected to the mandrel 608 and/or the insert 100. Suitable setting assemblies that are commercially-available include the Owen Oil Tools wireline pressure setting assembly or a Model 10, 20 E-4, or E-5 Setting Tool available from Baker Oil Tools, for example.

Figure 7:
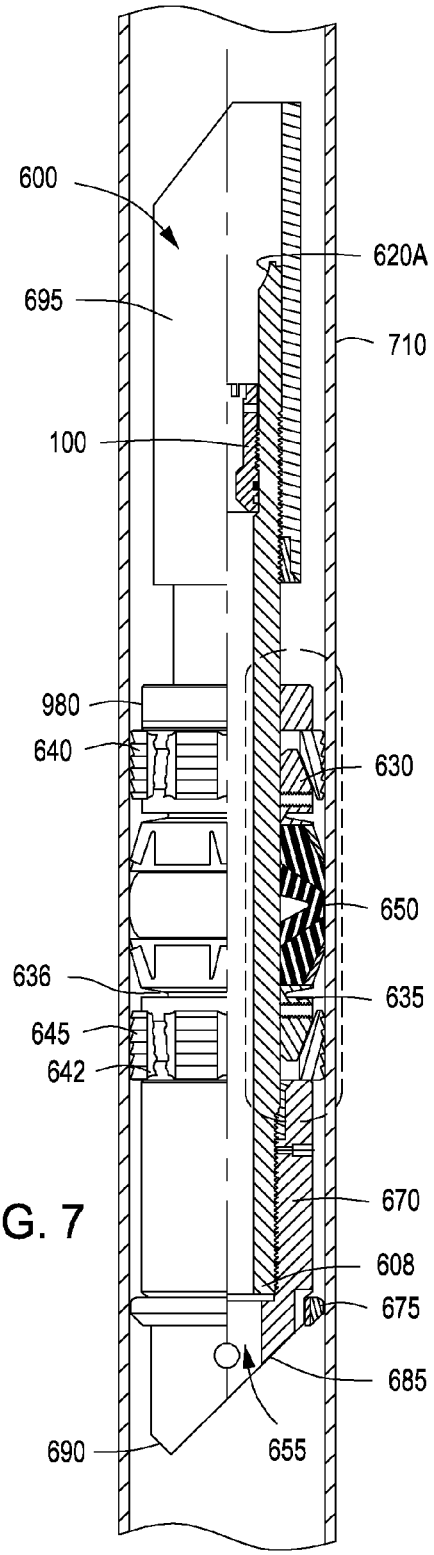
FIG. 7 depicts a partial section view of the plug of FIG. 6B located in an expanded or actuated position within the casing, according to one or more embodiments described.

During the setting process, the outer cylinder (not shown) of the setting tool exerts an axial force against the outer, upper end of the plug 600 in a downward direction that is matched by the adapter rod of the setting tool exerting an equal and opposite force in an upward direction. For example, in the embodiments illustrated in FIGS. 6A, 6B, 6C, 6D and 7, the outer cylinder of the setting assembly exerts an axial force on the annular member 680, which translates the force to the slips 640, 645 and the malleable elements 650 that are disposed about the mandrel 608 of the plug 600. The translated force fractures the recessed groove(s) 642 of the slips 640, 645, allowing the slips 640, 645 to expand outward and engage the inner surface of the casing or wellbore 710, while at the same time compresses the malleable elements 650 to create a seal between the plug 600 and the inner surface of the casing or wellbore 710, as shown in FIG. 7. FIG. 7 depicts an illustrative partial section view of the expanded plug 600, according to one or more embodiments described.

After actuation or installation of the plug 600, the setting tool can be released from the mandrel 608 of the plug 600, or the insert 100 that is screwed into the plug 600 by continuing to apply the opposing, axial forces on the mandrel 608 via the adapter rod and the outer cylinder. The opposing, axial forces applied by the outer cylinder and the adapter rod result in a compressive load on the mandrel 608, which is borne as internal stress once the plug 600 is actuated and secured within the casing or wellbore 710. In one embodiment, the force or stress can be focused on the shear mechanism 620 or a shear groove 620B (as depicted in FIG. 6A-6D), which will eventually shear, break, or otherwise deform at a predetermined force, releasing the adapter rod from the mandrel 608. The predetermined axial force sufficient to deform the shear mechanism 620 or shear groove 620B to release the setting tool is less than the axial force sufficient to break the plug 600.

Figure 8:
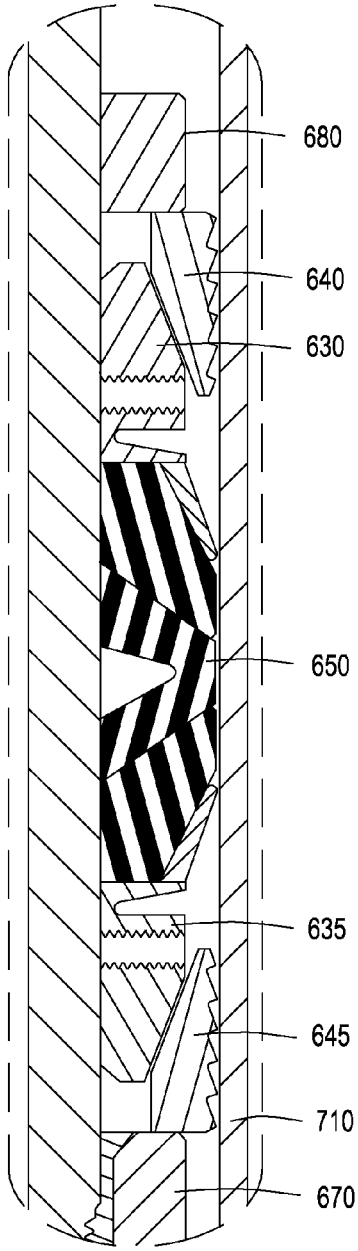
FIG. 8 depicts a partial section view of the expanded plug depicted in FIG. 7, according to one or more embodiments described.

Once actuated and released from the setting tool, the plug 600 is left in the wellbore to serve its purpose, as depicted in FIGS. 7 and 8. FIG. 8 depicts an illustrative partial section view of the expanded plug 600 depicted in FIG. 7, according to one or more embodiments described. For example, the ball 425 can be dropped in the wellbore to constrain, restrict, and/or prevent fluid communication in a first direction through the body 608. The dropped ball 425 can rest on the transition or ball seat 420 to form an essentially fluid-tight seal therebetween, preventing downward fluid flow through the plug 600 ("the first direction") while allowing upward fluid flow through the plug 600 ("the second direction"). In addition or alternatively, a second drop ball 623 can be dropped in the wellbore to constrain, restrict, and/or prevent fluid communication in a first direction through the body 608. The ball 623 can rest on the transition or ball seat 620A to form an essentially fluid-tight seal therebetween, preventing downward fluid flow through the plug 600 while allowing upward fluid flow through the plug 600. Alternatively, the flapper member 310 can rotate toward the closed position to constrain, restrict, and/or prevent downward fluid flow through the plug 600 ("the first direction") while allowing upward fluid flow through the plug 600 ("the second direction").

The ball 425, 623, 643 or the flapper member 310 can be fabricated from one or more decomposable materials. Suitable decomposable materials will decompose, degrade, degenerate, or otherwise fall apart at certain wellbore conditions or environments, such as predetermined temperature, pressure, pH, and/or any combinations thereof. As such, fluid communication through the plug 600 can be prevented for a predetermined period of time, e.g., until and/or if the decomposable material(s) degrade sufficiently allowing fluid flow therethrough. The predetermined period of time can be sufficient to pressure test one or more hydrocarbon-bearing zones within the wellbore. In one or more embodiments, the predetermined period of time can be sufficient to workover the associated well. The predetermined period of time can range from minutes to days. For example, the degradable rate of the material can range from about 5 minutes, 40 minutes, or 4 hours to about 12 hours, 24 hours or 48 hours. Extended periods of time are also contemplated.

The pressures at which the ball 425, 623, 643 or the flapper member 310 decompose can range from about 100 psig to about 15,000 psig. For example, the pressure can range from a low of about 100 psig, 1,000 psig, or 5,000 psig to a high about 7,500 psig, 10,000 psig, or about 15,000 psig. The temperatures at which the ball 425, 623, 643 or the flapper member decompose can range from about 100° F. to about 750° F. For example, the temperature can range from a low of about 100° F., 150° F., or 200° F. to a high of about 350° F., 500° F., or 750° F.

The decomposable material can be soluble in any material, such as soluble in water, polar solvents, non-polar solvents, acids, bases, mixtures thereof, or any combination thereof. The solvents can be time-dependent solvents. A time-dependent solvent can be selected based on its rate of degradation. For example, suitable solvents can include one or more solvents capable of degrading the soluble components in about 30 minutes, 1 hour, or 4 hours, to about 12 hours, 24 hours, or 48 hours. Extended periods of time are also contemplated.

The pHs at which the ball 425, 623, 643 or the flapper member 310 can decompose can range from about 1 to about 14. For example, the pH can range from a low of about 1, 3, or 5 to a high about 9, 11, or about 14.

To remove the plug 600 from the wellbore, the plug 600 can be drilled-out, milled, or otherwise compromised. As it is common to have two or more plugs 600 located in a single wellbore to isolate multiple zones therein, during removal of one or more plugs 600 from the wellbore some remaining portion of a first, upper plug 600 can release from the wall of the wellbore at some point during the drill-out. Thus, when the remaining portion of the first, upper plug 600 falls and engages an upper end of a second, lower plug 600, the anti-rotation features 670 of the remaining portions of the plugs 600, will engage and prevent, or at least substantially reduce, relative rotation therebetween.

FIGS. 9-12 depict schematic views of illustrative anti-rotation features 670 that can be used with the plugs 600 to prevent or reduce rotation during drill-out. These features are not intended to be exhaustive, but merely illustrative, as there are many other configurations that are equally effective to accomplish the same results. Each end of the plug 600 can be the same or different. For example, FIG. 9 depicts angled surfaces or half-mule anti-rotation feature; FIG. 10 depicts dog clutch type anti-rotation features; and FIGS. 11 and 12 depict two types of flats and slotted noses or anti-rotation features.

Referring to FIG. 9, a lower end of the upper plug 900A and an upper end of the lower plug 900B are shown within the casing 710 where the angled surfaces 985, 990 interact with, interface with, interconnect, interlock, link with, join, jam with or within, wedge between, or otherwise communicate with a complementary angled surface 925 and/or at least a surface of the wellbore or casing 900. The interaction between the lower end of the upper plug 900A and the upper end of the lower plug 900B and/or the casing 900 can counteract a torque placed on the lower end of the upper plug 900A, and prevent or greatly reduce rotation therebetween. For example, the lower end of the upper plug 900A can be prevented from rotating within the wellbore or casing 900 by the interaction with upper end of the lower plug 900B, which is held securely within the casing 900.

Referring to FIG. 10, dog clutch surfaces of the upper plug 1000A can interact with, interface with, interconnect, interlock, link with, join, jam with or within, wedge between, or otherwise communicate with a complementary dog clutch surface of the lower plug 1000B and/or at least a surface of the wellbore or casing 900. The interaction between the lower end of the upper plug 1000A and the upper end of the lower plug 1000B and/or the casing 900 can counteract a torque placed on the lower end of the upper plug 1000A, and prevent or greatly reduce rotation therebetween. For example, the lower end of the upper plug 1000A can be prevented from rotating within the wellbore or casing 900 by the interaction with upper end of the lower plug 1000B, which is held securely within the casing 900.

Referring to FIG. 11, the flats and slotted surfaces of the upper plug 1100A can interact with, interface with, interconnect, interlock, link with, join, jam with or within, wedge between, or otherwise communicate with a complementary flats and slotted surfaces of the lower plug 1100B and/or at least a surface of the wellbore or casing 900. The interaction between the lower end of the upper plug 1100A and the upper end of the lower plug 1100B and/or the casing 900 can counteract a torque placed on the lower end of the upper plug 1100A, and prevent or greatly reduce rotation therebetween. For example, the lower end of the upper plug 1100A can be prevented from rotating within the wellbore or casing 900 by the interaction with upper end of the lower plug 1100B, which is held securely within the casing 900. The protruding perpendicular surfaces of the lower end of the upper plug 1100A can mate in only one resulting configuration with the complementary perpendicular voids of the upper end of the lower plug 1100B. When the lower end of the upper plug 1100A and the upper end of the lower plug 1100B are mated, any further rotational force applied to the lower end of the upper plug 1100A will be resisted by the engagement of the lower plug 1100B with the wellbore or casing 900, translated through the mated surfaces of the anti-rotation feature 670, allowing the lower end of the upper plug 1100A to be more easily drilled-out of the wellbore.

One alternative configuration of flats and slotted surfaces is depicted in FIG. 12. The protruding cylindrical or semi-cylindrical surfaces 1210 perpendicular to the base 1201 of the lower end of the upper plug 1200A mate in only one resulting configuration with the complementary aperture(s) 1220 in the complementary base 1202 of the upper end of the lower plug 1200B. Protruding surfaces 1210 can have any geometry perpendicular to the base 1201, as long as the complementary aperture(s) 1220 match the geometry of the protruding surfaces 1201 so that the surfaces 1201 can be threaded into the aperture(s) 1220 with sufficient material remaining in the complementary base 1202 to resist rotational force that can be applied to the lower end of the upper plug 1200A, and thus translated to the complementary base 1202 by means of the protruding surfaces 1201 being inserted into the aperture(s) 1220 of the complementary base 1202. The anti-rotation feature 670 may have one or more protrusions or apertures 1230, as depicted in FIG. 12, to guide, interact with, interface with, interconnect, interlock, link with, join, jam with or within, wedge between, or otherwise communicate or transmit force between the lower end of the upper plug 1200A and the upper end of the lower plug 1200B. The protrusion or aperture 1230 can be of any geometry practical to further the purpose of transmitting force through the anti-rotation feature 670.

The orientation of the components or anti-rotation features 670 depicted in all figures is arbitrary. Because plugs 600 can be installed in horizontal, vertical, and deviated wellbores, either end of the plug 600 can have any anti-rotation feature 670 geometry, wherein a single plug 600 can have one end of the first geometry and one end of the second geometry. For example, the anti-rotation feature 670 depicted in FIG. 9 can include an alternative embodiment where the lower end of the upper plug 900A is manufactured with geometry resembling 900B and vice versa. Each end of each plug 600 can be or include angled surfaces, half-mule, mule shape, dog clutch, flat and slot, cleated, slotted, spiked, and/or other interdigitating designs. In the alternative to a plug 600 with complementary anti-rotation feature 670 geometry on each end of the plug 600, a single plug 600 can include two ends of differently-shaped anti-rotation features, such as the upper end may include a half-mule anti-rotation feature 670, and the lower end of the same plug 600 may include a dog clutch type anti-rotation feature 670. Further, two plugs 600 in series may each comprise only one type anti-rotation feature 670 each, however the interface between the two plugs 600 may result in two different anti-rotation feature 670 geometries that can interface with, interconnect, interlock, link with, join, jam with or within, wedge between, or otherwise communicate or transmit force between the lower end of the upper plug 600 with the first geometry and the upper end of the lower plug 600 with the second geometry.

Any of the aforementioned components of the plug 600, including the body, rings, cones, elements, shoe, etc., can be formed or made from any one or more metallic materials (such as aluminum, steel, stainless steel, brass, copper, nickel, cast iron, galvanized or non-galvanized metals, etc.), fiberglass, wood, composite materials (such as ceramics, wood/polymer blends, cloth/polymer blends, etc.), and plastics (such as polyethylene, polypropylene, polystyrene, polyurethane, polyethylethylketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer) polynitrile resins (such as polyacrylonitrile (PAN), polymethacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like)), as well as mixtures, blends, and copolymers of any and all of the foregoing materials.

However, as many components as possible are made from one or more composite materials. Suitable composite materials can be or include polymeric composite materials that are reinforced by one or more fibers such as glass, carbon, or aramid, for example. The individual fibers can be layered parallel to each other, and wound layer upon layer. Each individual layer can be wound at an angle of from about 20 degrees to about 160 degrees with respect to a common longitudinal axis, to provide additional strength and stiffness to the composite material in high temperature and/or pressure downhole conditions. The particular winding phase can depend, at least in part, on the required strength and/or rigidity of the overall composite material.

The polymeric component of the composite can be an epoxy blend. The polymer component can also be or include polyurethanes and/or phenolics, for example. In one aspect, the polymeric composite can be a blend of two or more epoxy resins. For example, the polymeric composite can be a blend of a first epoxy resin of bisphenol A and epichlorohydrin and a second cycoaliphatic epoxy resin. Preferably, the cycloaphatic epoxy resin is ARALDITE® RTM liquid epoxy resin, commercially available from Ciga-Geigy Corporation of Brewster, N.Y. A 50:50 blend by weight of the two resins has been found to provide the suitable stability and strength for use in high temperature and/or pressure applications. The 50:50 epoxy blend can also provide suitable resistance in both high and low pH environments.

The fibers can be wet wound. A prepreg roving can also be used to form a matrix. The fibers can also be wound with and/or around, spun with and/or around, molded with and/or around, or hand laid with and/or around a metallic material or two or more metallic materials to create an epoxy impregnated metal or a metal impregnated epoxy.

A post cure process can be used to achieve greater strength of the material. A suitable post cure process can be a two stage cure having a gel period and a cross-linking period using an anhydride hardener, as is commonly know in the art. Heat can be added during the curing process to provide the appropriate reaction energy that drives the cross-linking of the matrix to completion. The composite may also be exposed to ultraviolet light or a high-intensity electron beam to provide the reaction energy to cure the composite material.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A plug for isolating a wellbore, comprising:
- a mandrel having a bore formed therethrough;
- at least one sealing element about the mandrel;
- at least one slip about the mandrel;
- at least one conical member about the mandrel;
- a shear element located within the mandrel for engaging a setting tool that enters the bore of the mandrel through an upper end of the mandrel;
- an insert at least partially within the bore of the mandrel beneath the shear element and between the shear element and the sealing element, the insert comprising:
  - a body having a bore formed completely therethrough or a bore formed only partially therethrough;
  - at least one circumferential groove formed in an outer surface of the body, wherein the at least one circumferential groove is adapted to retain an elastomeric seal; and
  - one or more threads on the outer surface of the body for securing the insert into the mandrel,
  - wherein the insert remains at least partially within the bore of the mandrel after the shear element shears and releases the setting tool.

2. The plug of claim 1, wherein the one or more threads on the outer surface of the body are adapted to engage one or more threads on an inner surface of the mandrel.

3. The plug of claim 1, wherein the shear element is integral with the mandrel or the shear element is a separate component.

4. The plug of claim 1, wherein the bore of the body is formed completely therethrough to allow fluid flow in both axial directions through the insert.

5. The plug of claim 1, wherein the bore of the body is formed partially therethrough to block fluid flow in both axial directions through the insert.

6. The plug of claim 1, further comprising at least one interface on an end of the body for securing the insert into the mandrel, wherein the interface comprises a profile for engaging an installation tool, and the profile is selected from the group consisting of hexagonal, slotted, notched, cross-head, and square.

7. The plug of claim 1, wherein the mandrel is made of one or more composite materials.

8. The plug of claim 1, further comprising at least one anti-rotation feature on a first end of the plug, a second end of the plug, or both ends of the plug.

9. The plug of claim 1, wherein the setting tool comprises an adapter rod, an outer cylinder, or both.

10. A plug for isolating a wellbore, comprising:
a mandrel having a bore formed therethrough;
at least one sealing element about the mandrel;
at least one slip about the mandrel;
at least one conical member about the mandrel; and
a shear element located within the mandrel for engaging a setting tool that enters the bore of the mandrel through an upper end of the mandrel;
an insert at least partially within the bore of the mandrel beneath the shear element and between the shear element and the sealing element, the insert comprising:
a body having a bore formed completely therethrough, wherein a shoulder is formed on an inner surface of the body;
a ball within the bore of the body, wherein the ball is adapted to block fluid flow in at least one direction through the bore of the body and the bore of the mandrel when the ball is in contact with the shoulder;
a ball stop within the bore of the body, wherein the ball is between the shoulder and the ball stop;
at least one circumferential groove formed in an outer surface of the body, wherein the at least one circumferential groove is adapted to retain an elastomeric seal; and
one or more threads on the outer surface of the body for securing the insert into the mandrel,
wherein the insert remains at least partially within the bore of the mandrel after the shear element shears and releases the setting tool.

11. The plug of claim 10, wherein the one or more threads on the outer surface of the body are adapted to engage one or more threads on an inner surface of the mandrel.

12. The plug of claim 10, wherein the shear element is integral with the mandrel.

13. The plug of claim 10, wherein the ball stop is selected from the group consisting of a plate, an annular cover, a ring, a bar, a cage, and a pin.

14. The plug of claim 10, further comprising at least one interface on an end of the body for securing the insert into the mandrel, wherein the interface comprises a profile for engaging a tool, and the profile is selected from the group consisting of hexagonal, slotted, notched, cross-head, and square.

15. The plug of claim 10, wherein the mandrel is made of one or more composite materials.

16. The plug of claim 10, further comprising at least one anti-rotation feature on a first end of the plug, a second end of the plug, or both ends of the plug.

17. A plug for isolating a wellbore, comprising:
a mandrel having a bore formed therethrough;
a shear element located within the mandrel for engaging a setting tool that enters the bore of the mandrel through an upper end of the mandrel;
at least one sealing element about the mandrel;
at least one slip about the mandrel;
at least one conical member about the mandrel;
at least one anti-rotation feature on a first end of the plug, a second end of the plug, or both ends of the plug; and
an insert at least partially within the bore of the mandrel beneath the shear element and between the shear element and the sealing element, the insert comprising:
a body having a bore formed completely therethrough or a bore formed only partially therethrough;
at least one circumferential groove formed in an outer surface of the body;
an elastomeric seal within the at least one circumferential groove; and
one or more threads on the outer surface of the body that are adapted to engage one or more threads on an inner surface of the mandrel;
wherein the insert remains at least partially within the bore of the mandrel after the shear element shears and releases the setting tool.

18. The plug of claim 17, wherein the insert is solid and prevents fluid flow through the bore of the mandrel in both axial directions.

19. The plug of claim 17, wherein the setting tool comprises an adapter rod, an outer cylinder, or both.

20. A plug for isolating a wellbore, comprising:
a mandrel having a bore formed therethrough;
a shear element located within the mandrel for engaging a setting tool that enters the bore of the mandrel through an upper end of the mandrel;
at least one sealing element about the mandrel;
at least one slip about the mandrel;
at least one conical member about the mandrel;
an insert at least partially within the bore of the mandrel beneath the shear element and between the shear element and the sealing element, the insert comprising:
a body having a bore formed completely therethrough or a bore formed only partially therethrough;
at least one circumferential groove formed in an outer surface of the body, wherein the at least one circumferential groove is adapted to retain an elastomeric seal; and
one or more threads on the outer surface of the body for securing the insert into the mandrel,
wherein the insert remains at least partially within the bore of the mandrel after the shear element shears and releases the setting tool.

21. The plug of claim 20, wherein the one or more threads on the outer surface of the body are adapted to engage one or more threads on an inner surface of the mandrel.

22. The plug of claim 20, wherein the shear element is integral with the mandrel or a separate component that is adapted to engage the mandrel.

23. The plug of claim 20, wherein the mandrel is made of one or more composite materials.

24. The plug of claim 20, further comprising at least one anti-rotation feature on an upper end of the plug, a lower end of the plug, or both ends of the plug.

25. The plug of claim 20, wherein the setting tool comprises an adapter rod, an outer cylinder, or both.

26. The plug of claim 20, wherein the insert is blocked thereby preventing fluid flow through the bore of the mandrel in both axial directions.

27. The plug of claim 20, wherein the at least one shear element comprises one or more shear threads, shear screws, shear pins, or combinations thereof.

* * * * *